US010799764B2

(12) United States Patent
Lam et al.

(10) Patent No.: US 10,799,764 B2
(45) Date of Patent: Oct. 13, 2020

(54) MONOFIN

(71) Applicant: Stallion Sport Limited, San Po Kong, Kowloon (HK)

(72) Inventors: Sin Chi Ricky Lam, Hong Kong (HK); Ping Wai Lee, Shatin (HK); Joseph Lin, Torrance, CA (US)

(73) Assignee: Stallion Sport Limited, Hong Kong (HK)

( * ) Notice: Subject to any disclaimer, the term of this patent is extended or adjusted under 35 U.S.C. 154(b) by 0 days.

(21) Appl. No.: 16/293,326

(22) Filed: Mar. 5, 2019

(65) Prior Publication Data

US 2020/0282265 A1 Sep. 10, 2020

(51) Int. Cl.
*A63B 31/11* (2006.01)

(52) U.S. Cl.
CPC ..... *A63B 31/11* (2013.01)

(58) Field of Classification Search
CPC ..... A63B 31/00; A63B 31/08; A63B 31/10; A63B 31/11; A63B 2031/112; A63B 2031/115; A63B 2031/117; A63B 31/12; A63B 31/14
USPC ..... D21/806
See application file for complete search history.

(56) References Cited

U.S. PATENT DOCUMENTS

| | | | | |
|---|---|---|---|---|
| 2,172,938 | A * | 9/1939 | Kahn | A63B 31/14 441/63 |
| 3,165,764 | A * | 1/1965 | Christiansen | A63B 31/11 441/63 |
| D415,544 | S | 10/1999 | Applegate | |
| 6,120,336 | A * | 9/2000 | Kawai | A63B 31/11 441/62 |
| 6,764,362 | B1 | 7/2004 | Wenzel | |
| 6,881,113 | B2 | 4/2005 | Smith | |
| 7,510,453 | B2 | 3/2009 | Nguyen | |
| 7,527,540 | B2 | 5/2009 | Melius | |
| 9,433,825 | B1 | 9/2016 | Nguyen | |
| 9,649,534 | B2 | 5/2017 | Gage | |
| 9,855,464 | B2 * | 1/2018 | Nguyen | A63B 31/11 |
| 9,925,416 | B2 | 3/2018 | Wiseman | |
| 2010/0099312 | A1 | 4/2010 | Shieh | |
| 2018/0043214 | A1 | 2/2018 | Beittel et al. | |
| 2019/0336829 | A1 * | 11/2019 | de Grasse | A63B 31/11 |

* cited by examiner

*Primary Examiner* — Andrew Polay
(74) *Attorney, Agent, or Firm* — Raymond Sun

(57) ABSTRACT

A monofin has a fin having a left fluke, and right fluke, and a hinge section that hingedly connects the left fluke and the right fluke. The monofin also includes a left foot pocket connected to the left fluke, a right foot pocket connected to the right fluke, and a hinge assembly that hingedly connects the left foot pocket and the right foot pocket.

1 Claim, 3 Drawing Sheets

MONOFIN

BACKGROUND OF THE INVENTION

1. Field of the Invention

The present invention relates to a monofin for use when swimming.

2. Description of the Prior Art

A monofin is a type of swimming fin. A typical monofin consists of a single fin with foot pockets that hold the user's feet to the fin.

Monofins are often used in underwater sports such as finswimming, free-diving and underwater orienteering. Additionally, monofins have become very popular with children and adults who want to swim like a dolphin or a mermaid.

In some of these applications, the monofins may be used to keep both feet as close together for use as a training device. In this regard, it is desirable that the monofin can be folded up to facilitate convenient storage which does not take up a lot of space.

SUMMARY OF THE DISCLOSURE

The present invention provides a monofin assembly that can be easily and conveniently folded to facilitate convenient use and storage.

In order to accomplish the objects of the present invention, the present invention provides a monofin having a fin having a left fluke, and right fluke, and a hinge section that hingedly connects the left fluke and the right fluke. The monofin also includes a left foot pocket connected to the left fluke, a right foot pocket connected to the right fluke, and a hinge assembly that hingedly connects the left foot pocket and the right foot pocket.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
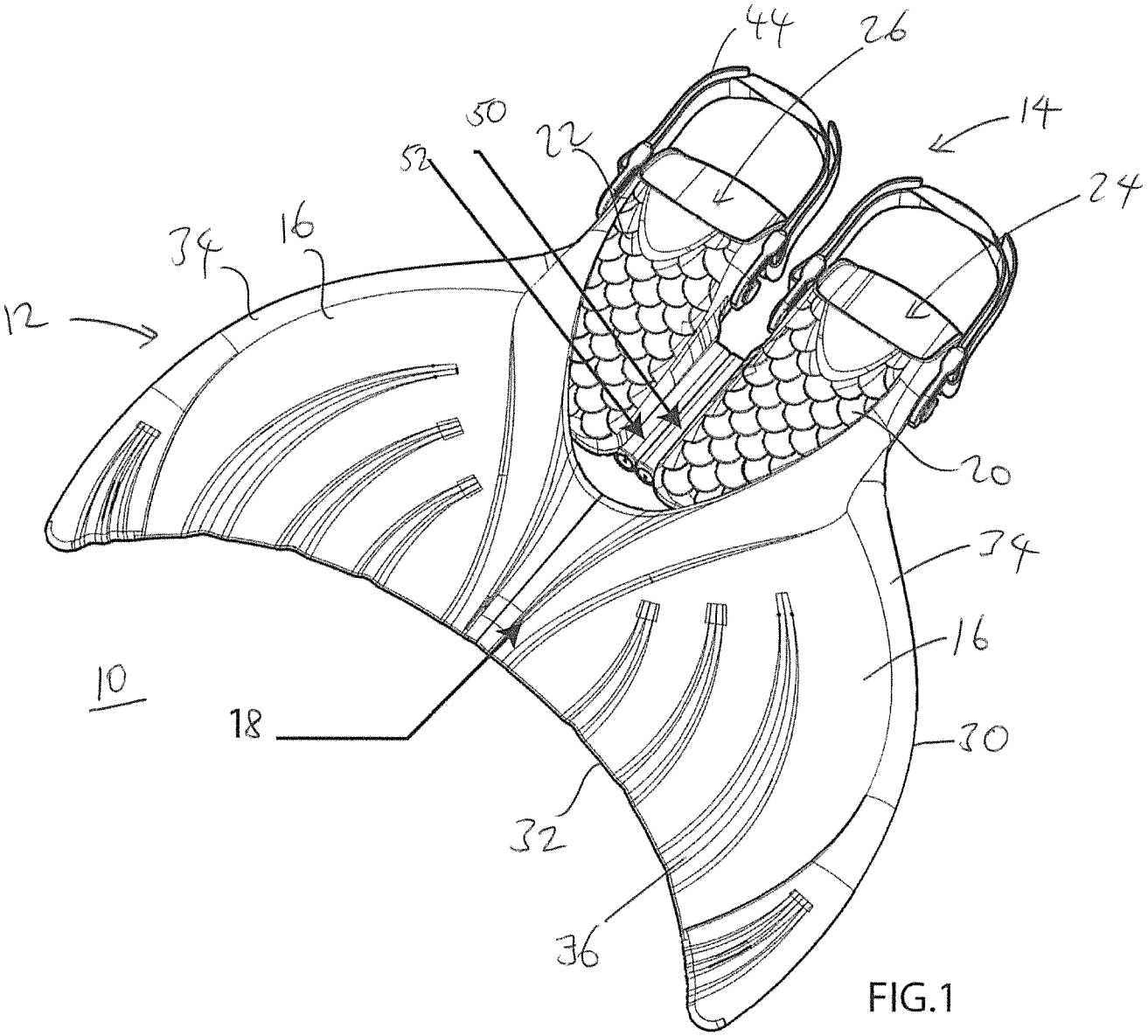
FIG. 1 is a perspective view of a monofin according to the present invention shown in a use configuration.
Figure 2:
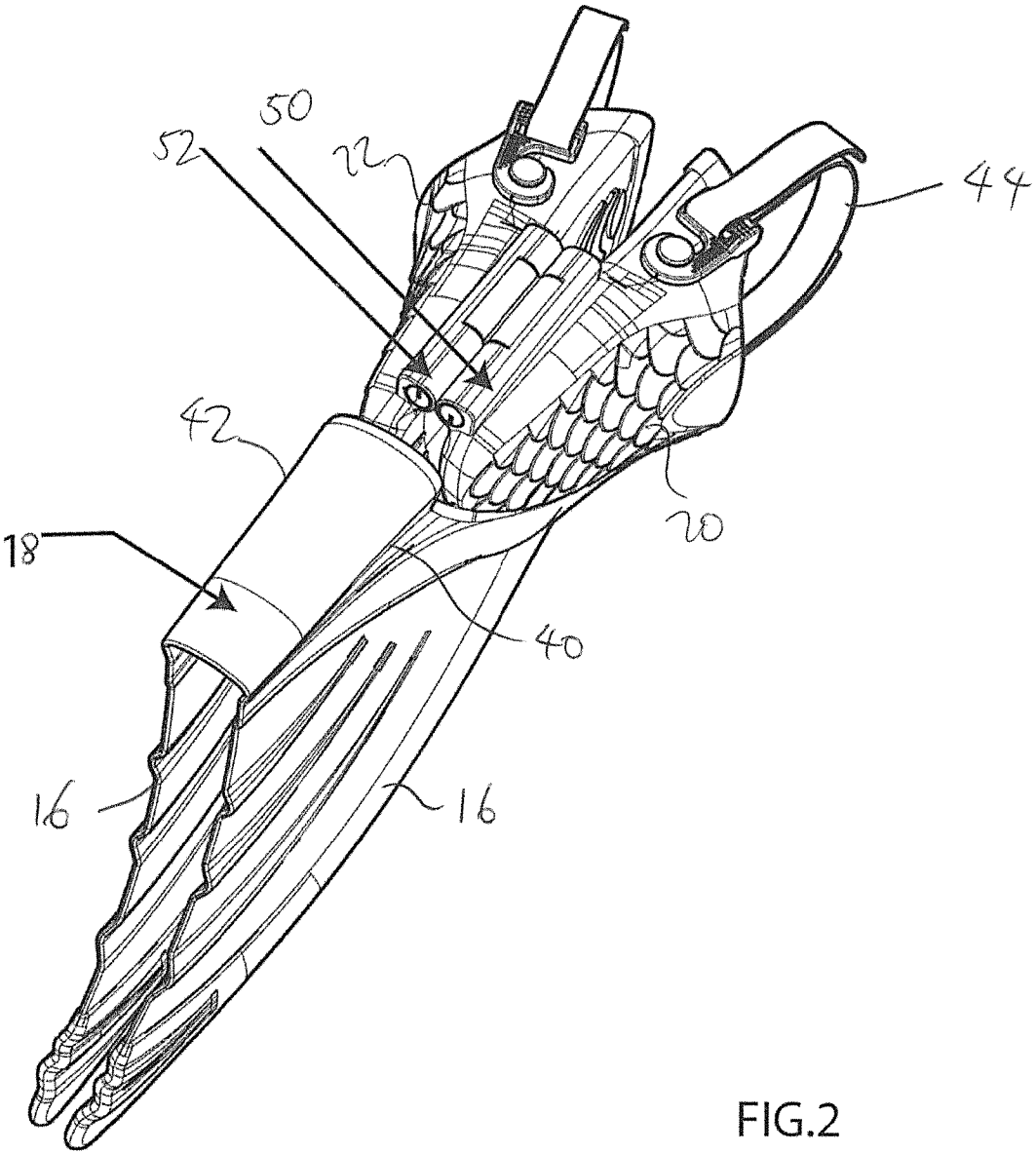
FIG. 2 is a perspective view of the monofin of FIG. 1 in a folded configuration.
Figure 3:
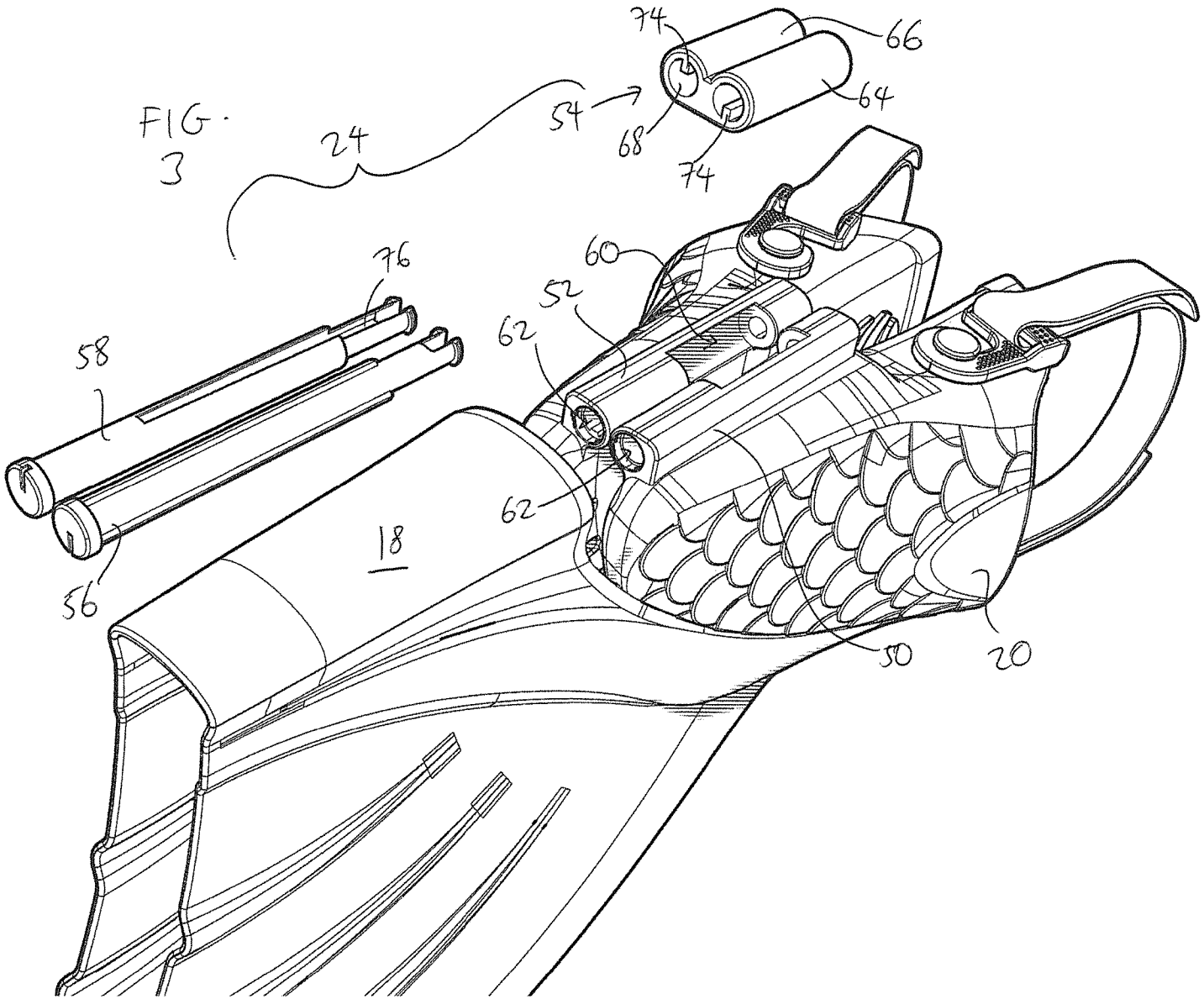
FIG. 3 is an exploded perspective view of the monofin of FIG. 1.

FIGS. 1-3 illustrate a monofin 10 that has a fin 12 and a foot pocket assembly 14. The fin 12, as illustrated, is shaped like a whale's tail consisting of two flukes 16. These two flukes 16 are the two halves of the fin 12 which meet in the middle along a hinge section 18. Each fluke 16 is a mirror image of the other. Each fluke 16 is also shaped like a triangle with curved sides, however, flukes 16 of other shapes such as squares, circles, rectangles, ovals, trapezoids and the like could also be used. While the fin 12 may be any shape desired, shaping fin 12 like a whale's tail is aesthetically pleasing and gives the user the feeling of swimming like a dolphin, whale, mermaid or the like.

The fin 12, itself, is formed from a thin, flexible, resilient material. The fin 12 must also be formed from a material that is strong enough to withstand the forces applied to it while the fin 12 is in use. Further, the fin 12 must be flexible enough to bend in the water as it is pushed back and forth by a user. Additionally, the fin 12 must resume its original shape when not in use or at other times during the user's stroke. Materials which may be used to form the fin 12 include polymers, plastics, composites, rubber or the like. Other materials with the properties described above may also be used.

The fin 12 has a leading edge 30 and a trailing edge 32. The leading edge 30 is the edge of the fin 12 that is pulled through the water by the user in their swimming stroke. The trailing edge 32 follows the path of the fin 12 through the stroke. The fin 12 can be slightly thicker at the leading edge 30, and the thickness can gradually thin towards the trailing edge 32. This difference in thickness in the fin 12 allows the trailing edge 32 to bend and flex during the user's swimming stroke, while the leading edge 30 is stronger and not as flexible.

The fin 12 can also include at least two ribs 34. The at least two ribs 34 begin at the back (leading edge 30) of the fin 12, and continue along the leading edge 30 to a location approximately half to three-quarters of the way down the fin 12. The ribs 34 are a thickening of the edge of the fin 12, and extend above the surface of both the top and the bottom of the fin 12. The ribs 34 add strength and stiffness to the fin 12. The ribs 34 may also be placed in other locations on the fin 12, and additional ribs 34 may be placed along the top and bottom surfaces of the fin 12 to add strength to the fin 12. Finally, the ribs 34 may be lengthened or shortened in order to change the movement of the fin 12 in the water.

The fin 12 may also contain, include or comprise corrugations 36. The corrugations 36 are creases formed in the fin 12. The fin 12 is formed with triangular peaks and triangular valleys which extend from the trailing edge 32 of the fin 12 through a majority of the fin 12 towards the leading edge 30. The corrugations 36 are formed with a similar curvature to the leading edge 30 of the fin 12. The path of the corrugations 36 therefore mimics the shape of the edge of the fin 12. The corrugations 36 are also located parallel to the leading edge 30. Additionally, the corrugations 36 could be formed over the entire length of the fin 12 from the back to the front trailing edge 32 or they could be formed in shorter lengths as desired. The corrugations 36 help to strengthen the fin 12.

The hinge section 18 is formed from a single piece of soft material, which can be the same as any of the materials used for the flukes 16 or for the foot pockets 20, 22 described below. The hinge section 18 has a first edge 40 that is hingedly connected to the left fluke 16 and a second edge 42 that is hingedly connected to the right fluke 16.

The fin 12 is attached to the user's feet through the foot pocket assembly 14. The foot pocket assembly 14 includes a left foot pocket 20 and a right foot pocket 22 that are hingedly connected to each other by a hinge assembly 24. The left foot pocket 20 is attached to the left fluke 16, and the right foot pocket 22 is attached to the right fluke 16. Each foot pocket 20 and 22 covers the user's feet while the user is using the monofin 10.

The foot pockets 20 and 22 may be formed from any material desired. However, it may be preferable to form the foot pockets 20 and 22 from a material which is soft, flexible and comfortable for users. Additionally, material which is strong, washable and which can withstand harsh pool chemicals may also be desired. Each foot pocket 20 and 22 has a foot opening 24 and 26, respectively, that allow the user's feet to be inserted into the respective foot pocket 20 and 22. The foot openings 24 and 26 may be formed in any size or shape desirable. They may also be formed at any location in the foot pocket 20 and 22. However, it is likely that a location towards the back of the foot pocket 20 and 22 will be desirable.

The foot openings 24 and 26 can optionally be surrounded or circumscribed by cuffs (not shown). The cuffs function to hold the monofin 10 on the user's feet, and can be formed from an elastic material with a high degree of elasticity and strength. In order for the cuffs to secure the monofin 10 to the user, the cuffs must stretch to snuggly fit multiple leg or ankle sizes. Once the user stretches the cuffs enough to insert their feet through the foot openings 24 and 26, the cuffs can automatically tighten due to the elasticity of the material.

The foot openings 24 and 26 are in communication with the foot pockets 20 and 22. The foot pockets 20 and 22 may be a pouch or pocket into which the user's foot is placed during use. The foot pockets 20, 22 comfortably hold the user's feet while allowing them to move freely with nothing stiff to rub against and cause pain. In this regard, the foot pockets 20 and 22 may be formed from any material desirable, i.e. rubber, fabric, plastic or the like. Straps 44 can be provided adjacent the foot openings 24 and 26 to hold each foot inside the respective foot pocket 20 and 22.

The hinge assembly 24 includes a pair of hinge blocks 50 and 52, a hinge piece 54, and a pair of pivot shafts 56 and 58. The inner edge of each foot pocket 20 and 22 is provided with a hinge block 50 and 52, respectively. Each hinge block 50 and 52 is an elongated block that can be made from the same material as the foot pocket 20, 22, and has a cut-out section 60. A bore 62 extends through each hinge block 50, 52 and also through the cut-out section 60.

The hinge piece 54 is shaped to define two generally cylindrical sections 64 and 66, with each cylindrical section 66, 66 having a bore 68. The hinge piece 62 is sized and configured to fit into the two cut-out sections 60 in a manner such that each cylindrical section 64 and 66 is adapted to be fitted a corresponding cut-out section 60 of the hinge blocks 50 and 52, respectively. Each pivot shaft 56 and 58 is inserted through a corresponding bore 62 of the hinge blocks 50 and 52, respectively, and then through a corresponding bore 68 of the cylindrical sections 64 and 66, respectively. This arrangement allows the two hinge blocks 50 and 52 to be pivoted about the hinge piece 52, which remains stationary.

To provide a more secure pivoting joint, each bore 68 is provided with an elongated rail 74 that is adapted to be fitted inside a corresponding longitudinal slot 76 that is cut from each pivot shaft 56 and 58.

When the foot pockets 20 and 22 are pivoted, the flukes 16 are pivoted about the hinge section 18.

FIG. 1 shows the monofin 10 in use. When the monofin 10 is to be stored, the user can simply fold the two foot pockets 20 and 22 about the hinge assembly 24, and the flukes 16 about the hinge section 18, to the configuration shown in FIG. 2. Thus, the present invention provides a monofin 10 that can be easily folded for use or storage. The hinge assembly 24 provides a secure pivoting connection between the foot pockets 20 and 22, and the hinge section 18 separates the flukes 16 in a manner which allows the fin 12 to maintain sufficient strength for use.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A monofin, comprising:

a fin having a left fluke, and right fluke, and a hinge section that hingedly connects the left fluke and the right fluke;

a left foot pocket connected to the left fluke;

a right foot pocket connected to the right fluke; and a hinge assembly that hingedly connects the left foot pocket and the right foot pocket, wherein the hinge assembly comprises:

a first hinge block provided on the left foot pocket, and a second hinge block provided on the right foot pocket, with each hinge block having a cut-out section and a bore extending through the hinge block;

a hinge piece seated inside the cut-out sections of the first and second hinge blocks, with the hinge piece having a first bore aligned with the bore of first hinge block and a second bore aligned with the bore of the second hinge block; and a first pivot shaft that extends through the first bore and the bore of the first hinge block, and a second pivot shaft that extends through the second bore and the bore of the second hinge block.

* * * * *